US011548112B2

(12) United States Patent
Balducci

(10) Patent No.: US 11,548,112 B2
(45) Date of Patent: Jan. 10, 2023

(54) SANDING MACHINE FOR THE SANDING/FINISHING PANELS MADE OF WOOD, METAL, OR THE LIKE

(71) Applicant: BIESSE S.P.A., Pesaro (IT)

(72) Inventor: Fabio Balducci, Falconara Marittima (IT)

(73) Assignee: Biesse S.p.a., Pesaro (IT)

( * ) Notice: Subject to any disclaimer, the term of this patent is extended or adjusted under 35 U.S.C. 154(b) by 825 days.

(21) Appl. No.: 16/536,218

(22) Filed: Aug. 8, 2019

(65) Prior Publication Data

US 2020/0047305 A1 Feb. 13, 2020

(51) Int. Cl.
*B24B 21/08* (2006.01)
*B24B 21/10* (2006.01)
*B24B 21/12* (2006.01)

(52) U.S. Cl.
CPC ..... *B24B 21/08* (2013.01); *B24B 21/10* (2013.01); *B24B 21/12* (2013.01)

(58) Field of Classification Search
CPC ..... B24B 21/06; B24B 21/08; B24B 21/10; B24B 21/12; B24B 21/14
USPC ..... 451/59, 300, 303
See application file for complete search history.

(56) References Cited

U.S. PATENT DOCUMENTS 3,374,583 A * 3/1968 Jacobi ..... B24B 21/08 125/11.01
3,524,285 A * 8/1970 Rutt ..... B24B 21/12 451/301
3,859,757 A * 1/1975 Heesemann ..... B24B 21/06 451/303
3,911,627 A * 10/1975 Heesemann ..... B24B 21/16 451/299
5,193,317 A * 3/1993 Nordquist ..... B24B 21/04 451/299
5,394,653 A * 3/1995 Maier ..... B24B 5/363 451/303

FOREIGN PATENT DOCUMENTS

DE 4232028 A1 * 3/1994 ..... B24B 21/10
EP 0571343 A1 11/1993
EP 2039465 A1 3/2009
EP 3009231 A1 4/2016
EP 3608056 A1 * 2/2020 ..... B24B 21/08

OTHER PUBLICATIONS

European Search Report and Opinion IT237 for IT 201800007999; Irina Arhire; 2018 (Year: 2018).*

* cited by examiner

*Primary Examiner* — Eileen P Morgan
(74) *Attorney, Agent, or Firm* — David B. Tingey; Bryant J. Keller; Kirton McConkie

(57) ABSTRACT

In a sanding machine for sanding/finishing panels made of wood, metal or the like, an abrasive belt is moved so as to cause it to come into contact with a panel by a plurality of thrust elements, which are distributed inside the abrasive belt, and are moved perpendicularly to the panel by respective actuator cylinders, each of which has an output rod which is moveable between a lowered operating position and a raised rest position under the thrust of a pressurised gas supplied in a continuous manner to an upper chamber of the actuator cylinder and in a selective manner to a lower chamber of the actuator cylinder itself.

13 Claims, 2 Drawing Sheets

SANDING MACHINE FOR THE SANDING/FINISHING PANELS MADE OF WOOD, METAL, OR THE LIKE

CROSS-REFERENCE TO RELATED APPLICATIONS

This patent application claims priority from Italian patent application no. 102018000007999 filed on Aug. 9, 2018, the disclosure of which is incorporated by reference.

TECHNICAL FIELD

The present invention relates to a sanding machine for sanding/finishing panels made of wood, metal, or the like.

BACKGROUND ART

In the field of sanding/finishing panels made of wood, metal, or the like, it is known to provide a sanding machine of the type comprising: a belt conveyor, which has an upper transport branch defining a substantially horizontal support surface for at least one panel, and which is designed to feed the panel in a given first direction; a sanding device mounted above the support surface to sand an upper face of the panel; and a detection device to detect a panel width in a second direction parallel to the support surface and transverse to the first direction.

The sanding device comprises an abrasive belt wound in a ring around a plurality of idler rollers and a plurality of thrust elements, which are distributed inside the abrasive belt in the second direction. The thrust elements are movable, independently of each other, in a third direction that is orthogonal to the support surface between respective lowered operating positions, in which the corresponding portions of the abrasive belt are moved so as to come into contact with the upper face of the panel, and respective raised rest positions, in which the corresponding portions of the abrasive belt disengage the upper face of the panel itself.

The thrust elements are fixed to the output rods of respective pneumatic actuator cylinders and are selectively moved to their lowered operating positions according to the width of the panel and/or the work to be carried out.

Each actuator cylinder comprises a cylinder, which is engaged in a sliding manner by its output rod, and is divided by the output rod itself into an upper chamber and a lower chamber.

The upper chamber can be selectively connected to a first pneumatic circuit by means of the interposition of a power supply solenoid valve, and the lower chamber is continuously connected to a second pneumatic circuit.

As a result, each thrust element is normally arranged in its raised rest position, and is selectively moved to its lowered operating position following the activation of the relative power supply solenoid valve.

The actuator cylinder comprises, in addition, a first annular gasket mounted on the output rod to separate the upper chamber from the lower chamber in a fluid-tight manner, a second annular gasket mounted on the output rod to separate the lower chamber from the upper chamber in a fluid-tight manner, and a third annular gasket mounted on the output rod to separate the lower chamber from the outside in a fluid-tight manner.

The first annular gasket is a lip gasket designed to expand radially under the thrust of the first pneumatic circuit, and the second annular gasket is a lip gasket designed to expand radially under the thrust of the second pneumatic circuit.

Since the lower chamber is continuously connected to the second pneumatic circuit, the known sanding machines of the type described above have some drawbacks mainly due to the fact that, in order to move each thrust element to its lowered operating position, the relative first pneumatic circuit must generate a pneumatic force at least equal to the sum of the pneumatic force generated by the second pneumatic circuit and of the friction force generated by the three gaskets.

As a result, the pneumatic force exerted by each first pneumatic circuit on the relative thrust element and, therefore, on the panels is relatively high and can compromise the correct sanding/finishing of the panels themselves.

DISCLOSURE OF INVENTION

It is an object of the present invention to provide a sanding machine for sanding/finishing panels made of wood, metal, or the like, which is free of the previously described drawbacks and which is simple and cheap to implement.

According to the present invention, there is provided a sanding machine for sanding/finishing panels made of wood, metal, or the like, as claimed in the appended claims.

BRIEF DESCRIPTION OF THE DRAWINGS

The present invention will now be described with reference to the accompanying drawings, which show a non-limiting embodiment thereof, wherein.

BEST MODE FOR CARRYING OUT THE INVENTION

Figure 1:
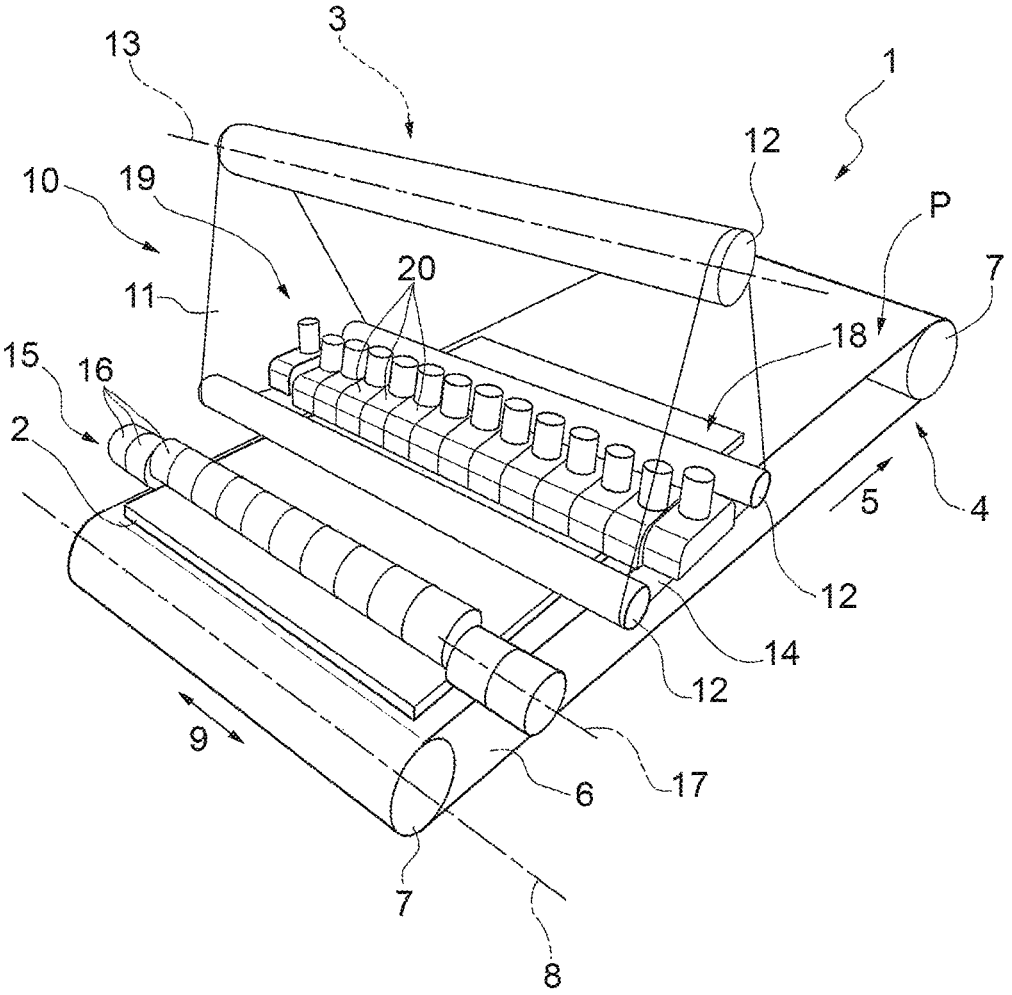
FIG. 1 is a schematic perspective view, with parts removed for the sake of clarity, of a preferred embodiment of the sanding machine of the present invention.

With reference to FIG. 1, the numeral 1 indicates, as a whole, a sanding machine for sanding/finishing panels made of wood, metal, or the like of a substantially parallelepiped shape.

The sanding machine 1 comprises a support frame 3 and a feeding device 4, mounted on the frame 3 for feeding the panels 2 in succession in a horizontal direction 5.

The device 4 comprises a belt conveyor 6, which has an upper transport branch defining a horizontal support surface P for the panels 2, and is wound in a ring around a pair of motorized pulleys 7 mounted to rotate, with respect to the frame 3, around respective longitudinal axes 8 that are parallel to each other and to a horizontal direction 9 transverse to direction 5.

The sanding machine 1 also comprises a sanding unit 10 comprising, in turn, an abrasive belt 11 wound in a ring around a plurality of idler rollers 12 (in this case three rollers 12), which are mounted to rotate around respective longitudinal axes 13 that are parallel to the direction 9 and are arranged in such a way as to give the belt 11 a substantially triangular configuration.

In particular, the arrangement of the rollers 12 is such that the belt 11 has a lower branch 14 that is substantially flat and parallel to the surface P.

The sanding machine 1 is also provided with a detection device 15 mounted above and at the entrance of the surface P to detect a panel width 2 in direction 9.

In this case, the device 15 is a mechanical detection device comprising a plurality of contact rollers 16, which are distributed above the surface P in direction 9, and are mounted to rotate around respective rotation axes 17 parallel to direction 9 itself.

Following the feeding of the panel 2 in direction 5, the rollers 16 arranged inside the feeding path of the panel 2 are lifted from the panel 2 so that the device 15 can detect the width of the panel 2 itself in direction 9. According to a variant not shown, the rollers 16 are removed and replaced with a detection device that is not in contact with the panels 2, e.g. of the optical, inductive, or capacitive types.

The lower branch 14 of the belt 11 is selectively brought into contact with an upper face 18 of the panels 2 by a thrust device 19 mounted inside the belt 11.

The device 19 comprises, in this case, a plurality of thrust elements 20, which are distributed inside the belt 11 in the direction 9, are mounted above the branch 14, and are movable independently of each other in a vertical direction 21 orthogonal to directions 5 and 9 and perpendicular to the surface P.

Each element 20 is movable in direction 21 between a lowered operating position, in which the corresponding portion of the belt 11 is moved so as to come into contact with the face 18, and a raised rest position, in which the corresponding portion of the belt 11 is disengaged from the face 18 itself.

Figure 2:
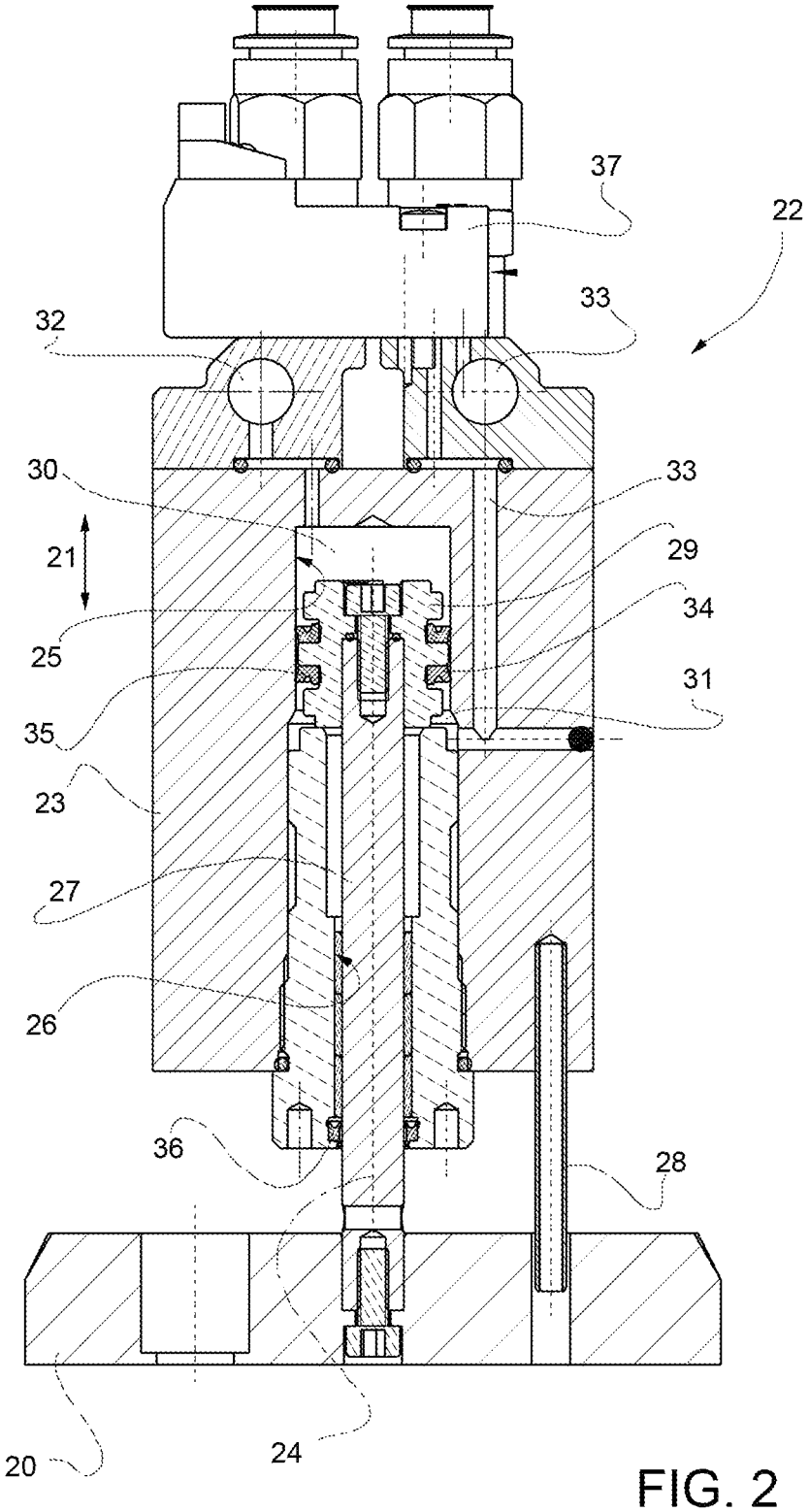
FIG. 2 is a schematic longitudinal cross-section of a detail of the sanding machine in FIG. 1.

As shown in FIG. 2, each element 20 is moved between its lowered operating position and its raised rest position by a relative actuator cylinder 22 comprising a cylinder 23, which has a substantially vertical longitudinal axis 24, and is configured so as to define a wider upper portion 25 and a narrower lower portion 26.

The element 20 has the shape of a slab fixed to the free end of an output rod 27 of the actuator cylinder 22 transversally to the axis 24. It is coupled in a sliding manner and angularly fixed to the cylinder 23 by means of at least one coupling pin 28 that protrudes upwards from the element 20 parallel to direction 21.

The rod 27 is engaged in a sliding manner in the narrower lower portion 26 coaxially to the axis 24, protrudes downwards from the cylinder 23 in direction 21, and is provided with a plate 29, which is engaged in a sliding manner in the wider upper portion 25, and divides the cylinder 23 into an upper chamber 30 and a lower chamber 31.

Chamber 30 is continuously connected with a pneumatic compressed air circuit 32 to move the element 20 to its lowered operating position; and chamber 31 can be selectively connected with a pneumatic compressed air circuit 33 to move the element 20 to its raised rest position.

With regard to the above, it should be noted that the pressure of the compressed air supplied to chamber 30 is lower than the pressure of the compressed air supplied to chamber 31.

The actuator cylinder 22 also comprises: a first annular gasket 34 mounted on the rod 27 to separate chamber 30 from chamber 31 in a fluid-tight manner; a second annular gasket 35 mounted on the rod 27 to separate chamber 31 from chamber 30 in a fluid-tight manner; and a third annular gasket 36 mounted on the rod 27 to separate chamber 31 from the outside in a fluid-tight manner.

Gasket 34 is a lip gasket designed to expand radially under the thrust of the compressed air supplied to chamber 30 by circuit 32, and gasket 35 is a lip gasket designed to expand radially under the thrust of compressed air supplied to chamber 31 by circuit 33.

Chamber 31 is selectively connected to circuit 33 by means of a power supply solenoid valve 37 that is, normally, arranged in an open position, in which the compressed air supplied to chamber 31 generates a pneumatic force on the rod 27 that is greater than the sum of a pneumatic force generated on the rod 27 by the compressed air supplied in chamber 30 by circuit 32 and a friction force generated on the rod 27 by seals 34, 35, and 36.

In other words, when the solenoid valve 37 is open, the element 20 is arranged in its raised rest position.

The solenoid valve 37 comprises an electric circuit (known and not shown), the power supply of which controls the movement of the solenoid valve 37 itself from its open position to a closed position.

When the solenoid valve 37 is moved to its closed position, chamber 31 is connected to the outside, the pneumatic force generated by chamber 31 is substantially zero, the friction force generated by gaskets 35 and 36 is relatively low, and the element 20 is moved from its raised rest position to its lowered operating position by the compressed air supplied to chamber 30 by circuit 32.

In other words, when the solenoid valve 37 is closed, the compressed air is only supplied to chamber 30. As a result, the element 20 is moved to its lowered operating position with a pneumatic force that is relatively low and greater than the (relatively low) friction force generated on the rod 27 by gaskets 34, 35, and 36.

According to a first variant not shown, chamber 30 is selectively supplied with compressed air at a first pressure via circuit 32 and with compressed air at a second pressure that is different from the first pressure by means of an additional pneumatic circuit. Chamber 30 is selectively connected to circuit 32 or to the additional pneumatic circuit by means of a valve device in order to selectively control the sanding force exerted by the element 20 on the panels 2.

According to an additional variant not shown, each actuator cylinder 22 is provided with a pressure regulator to selectively control a supplying pressure to chamber 30 and thus to continuously regulate the sanding force exerted by the relative element 20 on the panels 2.

The invention claimed is:

1. A sanding machine for sanding/finishing panels (2) made of wood, metal or the like, the sanding machine comprising a feeding device (4), which defines a support surface (P) for at least one panel (2) and is designed to feed the panel (2) in a first direction (5); a sanding device (10), which is mounted above the support surface (P) and comprises, in turn, an abrasive belt (11), which is wound in a ring shape around a plurality of idler rollers (12) so as to sand an upper face (18) of the panel (2); a plurality of thrust elements (20), which are distributed inside the abrasive belt (11) in a second direction (9), which is transverse to the first direction (5) and parallel to the support surface (P); and, for each thrust element (20), a respective actuator cylinder (22) to move the thrust element (20) between a lowered operating position, in which the thrust element (20) moves the abrasive belt (11) so as to cause it to come into contact with the upper face (18) of the panel (2), and a raised rest position; each actuator cylinder (22) comprising a cylinder (23), an output rod (27), which is engaged in the cylinder (23) in a sliding manner and is configured to divide the cylinder (23) into an upper chamber (30) and a lower chamber (31), a first pneumatic circuit (32) communicating with the upper chamber (30) so as to move the thrust element (20) to its lowered operating position, and a second pneumatic circuit (33) communicating with the lower chamber (31) so as to move the thrust element (20) to its raised rest position; and being characterized in that the first pneumatic circuit (32) is configured to supply the upper chamber (30) in a continuous manner and the second pneumatic circuit (33) is provided with a valve device (37) to supply the lower chamber (31) in a selective manner.

2. A sanding machine according to claim 1, wherein the first pneumatic circuit (32) has a supplying pressure which is smaller than a supplying pressure of the second pneumatic circuit (33).

3. A sanding machine according to claim 1 and comprising, furthermore, a first annular gasket (34) to separate the upper chamber (30) from the lower chamber (31) in a fluid-tight manner, a second annular gasket (35) to separate the lower chamber (31) from the upper chamber (30) in a fluid-tight manner, and a third annular gasket (36) to separate the lower chamber (31) from the outside in a fluid-tight manner.

4. A sanding machine according to claim 3, wherein said first, second and third annular gaskets (34, 35, 36) are mounted on the output rod (27).

5. A sanding machine according to claim 3, wherein the first annular gasket (34) is a lip gasket designed to radially expand due to the thrust of the first pneumatic circuit (32), and wherein the second annular gasket (35) is a lip gasket designed to radially expand due to the thrust of the second pneumatic circuit (33).

6. A sanding machine according to claim 1, wherein the valve device (37) is movable between an open position and a closed position of the second pneumatic circuit (33).

7. A sanding machine according to claim 6, wherein, when the valve device (37) is arranged in its closed position, the lower chamber (31) communicates with the outside.

8. A sanding machine according to claim 6, wherein the first pneumatic circuit (32) is configured to supply the upper chamber (30) both when the valve device (37) is arranged in its closed position and when the valve device (37) is arranged in its open position.

9. A sanding machine according to claim 6, wherein the valve device (37) comprises a solenoid valve, which is normally arranged in its open position and is provided with an electric circuit, whose power supply controls the movement of the solenoid valve from its open position to its closed position.

10. A sanding machine according to claim 1, wherein each thrust element (20) is fixed to a free end of the output rod (27) of the relative actuator cylinder (22).

11. A sanding machine according to claim 1, wherein each thrust element (20) is coupled to the cylinder (23) in a sliding and angularly fixed manner.

12. A sanding machine according to claim 1, wherein each actuator cylinder (22) comprises a third pneumatic circuit to supply the upper chamber (30) with a supplying pressure that is different from a supplying pressure of the first pneumatic circuit (32); a further valve device being provided in order to selectively connect the upper chamber (30) to the first pneumatic circuit (32) and to the third pneumatic circuit.

13. A sanding machine according to claim 1, wherein each actuator cylinder (22) comprises, furthermore, a pressure regulator to selectively control a supplying pressure of the upper chamber (30).

* * * * *